US005399047A

United States Patent [19]

Stegall

[11] Patent Number: 5,399,047

[45] Date of Patent: Mar. 21, 1995

[54] TRENCH FORMING ASSEMBLIES HAVING ENHANCED ANCHORING MEANS

[75] Inventor: Lannie L. Stegall, Versailles, Ky.

[73] Assignee: ABT, Inc., Troutman, N.C.

[21] Appl. No.: 120,214

[22] Filed: Sep. 13, 1993

[51] Int. Cl.[6] ..... E02B 5/00; E02B 11/00; E01C 11/22

[52] U.S. Cl. ..... 405/119; 405/118; 404/4

[58] Field of Search ..... 405/118–121; 404/2–4, 8, 25, 26; 249/1, 10, 11; 425/59, 63

[56] References Cited

U.S. PATENT DOCUMENTS

| | | |
|---|---|---|
| 786,305 | 4/1905 | McIntyre . |
| 1,473,551 | 11/1923 | Gschwind . |
| 1,562,780 | 11/1925 | Mickelson . |
| 1,631,825 | 8/1939 | Adler . |
| 1,699,948 | 1/1929 | Biedermann . |
| 1,722,038 | 8/1929 | Dougherty . |
| 2,170,671 | 8/1939 | Adler . |
| 2,657,447 | 11/1953 | Pellanda, Jr. . |
| 2,677,165 | 9/1990 | Picollo et al. . |
| 2,917,804 | 12/1959 | Barron . |
| 2,938,437 | 5/1960 | Daley . |
| 3,212,267 | 10/1965 | Biehn . |
| 3,299,785 | 1/1967 | James . |
| 3,362,167 | 1/1968 | Ward . |
| 3,568,455 | 3/1971 | McLaughlin et al. . |
| 3,625,011 | 12/1971 | Stevenson . |
| 3,797,188 | 3/1974 | Mansfeld . |
| 4,142,371 | 3/1979 | Mayfield . |
| 4,258,897 | 3/1981 | Stees . |
| 4,472,078 | 9/1984 | Karbstein . |
| 4,498,807 | 2/1985 | Kirkpatrick et al. . |
| 4,787,773 | 11/1988 | Kehler . |
| 4,844,655 | 7/1989 | Aleshire . |
| 4,878,782 | 11/1989 | Beattie et al. . |
| 4,957,268 | 9/1990 | Picollo et al. . |
| 4,993,877 | 2/1991 | Beamer . |
| 4,993,878 | 2/1991 | Beamer . |
| 5,000,621 | 3/1991 | Beamer . |
| 5,061,116 | 10/1991 | Monks . |
| 5,066,165 | 11/1991 | Wofford et al. . |

FOREIGN PATENT DOCUMENTS

| | | |
|---|---|---|
| 968267 | 10/1982 | U.S.S.R. . |
| WO90/11405 | 10/1990 | WIPO . |

OTHER PUBLICATIONS

*Trench Former System,* brochure by ABT, Inc., TF Jun. 1992.

*Neenah Foundry Company Catalog,* 1986, pp. 262–263; and 1985 (two pages unnumbered).

*Trench Former System,* brochure by ABT, Inc., TF Jun. 1992.

EconoDrain TM by MultiDrain Brochure (1992).

EconoDrain TM by MultiDrain (02725/MUN–Buy-Line 7497).

*Primary Examiner*—Dennis L. Taylor

*Attorney, Agent, or Firm*—Bell, Seltzer, Park & Gibson

[57] ABSTRACT

A trench forming assembly for forming a trench of predetermined shaped is disclosed according to the present invention. The assembly includes a pair of parallel elongate frame members for defining a support surface for supporting a trench cover. The assembly also includes an elongate form body for shaping a hardenable trench forming composition into the predetermined shape of the trench and having opposed side surfaces with which the frame members may be engaged. The trench forming assembly further includes at least one pair of upwardly extending legs for anchoring the frame members in a predetermined location. Each upwardly extending leg is joined at a top portion to one of the frame members and is joined at a lower portion to a corresponding leg for forming a generally U-shaped structure. The generally U-shaped anchoring leg structure maintains engagement of the frame members with the side surfaces of the form body. Once the trench is formed, the frame members may be removed, if desired, from the top portions of the upwardly extending legs to expose a pair of grate receiving recesses.

43 Claims, 4 Drawing Sheets

TRENCH FORMING ASSEMBLIES HAVING ENHANCED ANCHORING MEANS

FIELD OF THE INVENTION

The invention relates to methods and apparatus for forming trenches. More particularly, the invention relates to methods and apparatus for forming a trench employing a form body.

BACKGROUND OF THE INVENTION

Drainage and other trenches of various sizes and shapes are desirable for numerous applications. For example, manufacturing facilities typically require drainage systems which include trenches formed in the building floors to collect, remove and/or recycle excess water or other liquids. In addition, numerous outdoor industrial and commercial sites, such as parking lots, require drainage systems, including trenches, to collect and direct rainwater and other liquids to underground storm sewers to prevent flooding and to decrease runoff.

In the past, these trenches have generally been formed by first placing and securing a form of predetermined shape in a ditch which has previously been formed in the ground. A moldable trench forming composition, such as cement, concrete, or the like is then poured around the form and is allowed to set. Once the concrete has set, the form is removed from the resulting trench.

One common type of form assembly used to define a trench includes a wooden frame and strut structure. The wooden form includes a wooden frame which is covered with wooden sheets or planks to define a generally rectangular elongate trough. The wooden form is typically enclosed along its side and bottom faces, but may have an open top. Typically, a number of supporting wooden ribs are installed within the wooden form to increase the strength of the form so that it can withstand the relatively large pressures exerted by moldable trench forming compositions poured about it.

The wooden form is placed and secured within a preformed ditch. Concrete is typically poured up to the bottom face of the form and allowed to set. Then additional concrete is poured between the earthen walls of the ditch and the wooden sides of the form. Once all of the concrete has set, the wooden form is disassembled and removed from the trench.

Wooden forms are generally formed of lumber having a relatively rough exterior texture. Correspondingly, the inside surface of the trench formed by the wooden form is relatively uneven which reduces the efficiency of the flow of liquid through the trench. In addition, the assembly and disassembly of the wooden forms is both costly and labor intensive. The relatively large cost and labor required for assembly and disassembly of the wooden forms is increased in the formation of long trenches, and even further increased in the formation of trenches having a pitched or slanted bottom surface to facilitate drainage.

It is normally desirable to finish the trench with an elongate grate covering its open top in order to prevent people from unwittingly stepping in the open trench, to provide a smooth surface for vehicle travel, and/or to prevent relatively large objects from entering the trench and potentially blocking the flow of liquid therethrough. The grate is generally supported by a pair of spaced apart frame members which are set into and extend from the walls of the concrete trench. In order to stabilize the grate and to prevent the grate from rocking when weight, such as from a passing vehicle, is applied thereto, the frame members must be aligned in a common plane during the pouring and setting of the concrete about the form. If the grate is not properly aligned, the grate, the frame members and/or the concrete trench itself may be damaged by the resulting movement of the grate. If the grate rocks excessively, the grate may even be dislodged from the frame members thus leaving the trench exposed. Accordingly, the alignment of the frame members in the moldable trench forming composition is both important and laborious.

In an attempt to properly align the frame members without laborious manual alignment, precast trench assemblies have been developed. Precast trench assemblies generally include preformed metal and/or plastic assemblies designed to be placed in a preformed ditch. Moldable trench forming composition may thereafter be poured about the precast trench assembly. Once the trench forming composition has set, the precast trench assembly is securely bonded to the trench forming composition to stabilize and support the trench. Precast trench assemblies, however, are relatively expensive and may only be used once.

Commercially significant methods and apparatus for forming trenches, together with improved removable forms for forming trenches, are disclosed in U.S. patent application Ser. No. 07/768,610 to Stegall filed Sep. 26, 1991. In advantageous embodiments thereof inexpensive forms are employed to form trenches having properly aligned frame members. The trench forming assembly disclosed in U.S. patent application Ser. No. 07/768,610 preferably includes longitudinal frame members having a plurality of anchoring rods extending downwardly from the frame members. An elongate form body, preferably formed of relatively lightweight expanded polystyrene, preferably includes aligned longitudinal slots in the opposed side walls for receiving the frame members. Horizontal portions of the frame members are secured within the longitudinal slots in the sidewalls of the form body during formation of the trench so that the frame members are held in alignment during the trench forming operation. In typical practice, one or more wires are wrapped around the outside of the form body and frame members to hold the frame members in the slots of the form.

Preferably the assembled form and frame members are placed into a prepared ditch by suspending the assembly from its top. Concrete is first poured around the bottom of the anchoring legs attached to the frame members and allowed to set. Then concrete is poured around the form body and allowed to set. Finally the form body is removed to expose the resulting trench and the properly aligned frame members. The removal of the form is preferably facilitated by a pair of slots extending a relatively short distance into the form body from its bottom surface. Wires are provided in the slots and, once the trench forming composition has set, are pulled upwardly through the form. The form body is thereby cut into several pieces that can be more easily removed from the trench.

This system has greatly simplified the trench forming process and has achieved significant commercial success. In typical commercial practice, such form assemblies have been prepared on a custom basis by cutting one or more forms of desired shape and preparing frame members of desired length having anchoring legs welded thereto. These various parts have been assembled on-site using wires or other tying members to secure the frame members into the slots in the side surfaces of the form body. Due in part to the bulk and size of the frame member/welded anchoring leg portions of the assembly, shelf stocked inventories of the system have been limited.

SUMMARY OF THE INVENTION

The present invention provides improved trench forming methods and apparatus. In one aspect the invention provides trench forming systems that employ anchoring members adapted for engaging the elongate frame members with a form body without requiring the use of tying members such as wires or the like for securing the frame members to the form body. In another aspect the invention provides component based trench forming assemblies that can be more readily stocked in inventory and assembled in the field. In still another aspect the invention provides assemblies and methods for forming trenches in which the hardenable trench forming composition itself, e.g., concrete, is accurately shaped to support a trench covering grate; thus the metal frame members normally used to support the grate are eliminated.

In one aspect, the invention provides trench forming systems having enhanced anchoring members and arrangements. According to this aspect of the invention, a trench forming assembly includes a pair of elongate frame members that define a support surface for supporting a trench cover, an elongate form body for shaping a hardenable trench forming composition into the predetermined shape of the trench and which comprises opposed side surfaces, and engagement means cooperating with the opposed side surfaces of the form body for engaging the elongate frame members along opposed side surfaces of the form body. Anchoring means for anchoring the frame members in a predetermined location, such as a prepared ditch, comprise at least one pair of upwardly extending legs, each of which are joined at a top portion thereof to one of the elongate frame members and are joined together at their lower portions to form a generally U-shaped structure. Because the previously separate anchoring legs are, in accordance with the present invention, joined together at their lower portions to provide a generally U-shaped structure, the anchoring legs function to maintain engagement between the parallel, elongate frame members and the opposed side surfaces of the form body. Advantageously, the U-shaped structure is constructed and arranged such that the upwardly extending legs are biased inwardly, i.e., toward each other, at their top portions, to increase engagement between the elongate frame members and the sides of the form body.

In preferred embodiments, the U-shaped members and the elongate frame members are initially provided as separate trench assembly components and are connected together, typically on site, by an engageable connecting means. One preferred engagement means comprises at least one tab member fixedly attached to each of the elongate frame members. The tab member advantageously includes a bore for receiving one end of an anchoring leg. One end of the anchoring leg is then passed through the bore of the tab member and secured to the tab, and thus to the frame member, by a mechanical connector, such as a threaded nut. It is also preferred that a plurality of U-shaped anchoring members be connected to each pair of elongate frame members. Because the U-shaped anchoring members are separate from the frame members prior to assembly the system of the invention can be more readily stocked in inventory for use by various customers without requiring custom manufacture or installation. The inventory system can also include a preformed form bodies as will be apparent.

It is also preferred that the engagement means cooperating with the opposed side surfaces of the form body comprise a pair of horizontally oriented co-planar slots for receiving an elongate horizontal leg of a frame member. In this preferred embodiment, following attachment of the U-shaped anchoring members to the frame members so that the elongate frame members are parallel to each other, the form body is slipped between the rail members with the horizontal legs of the frame members engaging the slots in the side of the form body. The U-shaped anchoring members provide sufficient inwardly directed force on the frame members to maintain engagement of the frame members with the slots in the side of the form body.

In another aspect of the invention, trench forming assemblies and methods of forming trenches are provided wherein the frame members used in forming the trench define a grate supporting surface by shaping hardenable material, such as concrete, into a pair of grate receiving recesses. The frame members may be removed following hardening of the trench forming material to expose the grate receiving recesses.

In accordance with this aspect of the invention, a disengageable connecting means is provided for connecting top portions of upwardly extending anchoring legs to the elongate frame members. The disengageable connecting means are adapted to provide disengagement of the elongate frame members from the anchoring legs following hardening of the trench forming composition. In this aspect of the invention, the parallel elongate frame members are engaged along opposed side surfaces of the form body as in the previously discussed embodiments of the invention. The anchoring legs can be provided separately, or in pairs joined at their bottom into a U-shaped structures, as previously discussed. The connecting means for connecting the frame members to the anchoring legs are disengaged following formation of a hardened trench around the form body. The frame members are then removed from the hardened trench to expose a hardened trench-forming composition which has been shaped by contact with the frame members to thus provide an integrally formed grate receiving recess along the sides of the trench. Because the metal frame members are removed, the cost for constructing the trench is reduced. In addition, the trench can be used in environments which are corrosive to metal materials.

Preferably, the disengageable connecting means is provided by a connecting member which passes through a bore in the frame members in the direction from the inside surfaces of the frame members to the outside thereof. Accordingly, when the connecting member is removed, there are no protrusions in the integrally formed recesses formed along the sides of the trench.

In the various embodiments of the invention the improved anchoring means can substantially simplify construction of trenches because as discussed above, no tying wires are required in the preferred embodiments in order to secure the elongate frame members to the form bodies. In preferred embodiments where U-shaped anchoring members are employed, the bottom portion of the U-shaped members also serve to increase anchoring of the members in a subslab poured beneath the trench. The U-shaped members can be stored in substantially flat form and can be readily attached to the elongate frame members with out requiring the use of highly skilled labor. In embodiments of the invention wherein the metal frame members are removed following construction of the trench, costs associated with the trench are decreased significantly.

BRIEF DESCRIPTION OF THE DRAWINGS

In the drawings which form a portion of the original disclosure of this application.

DETAILED DESCRIPTION OF THE PREFERRED EMBODIMENT

Figure 1:
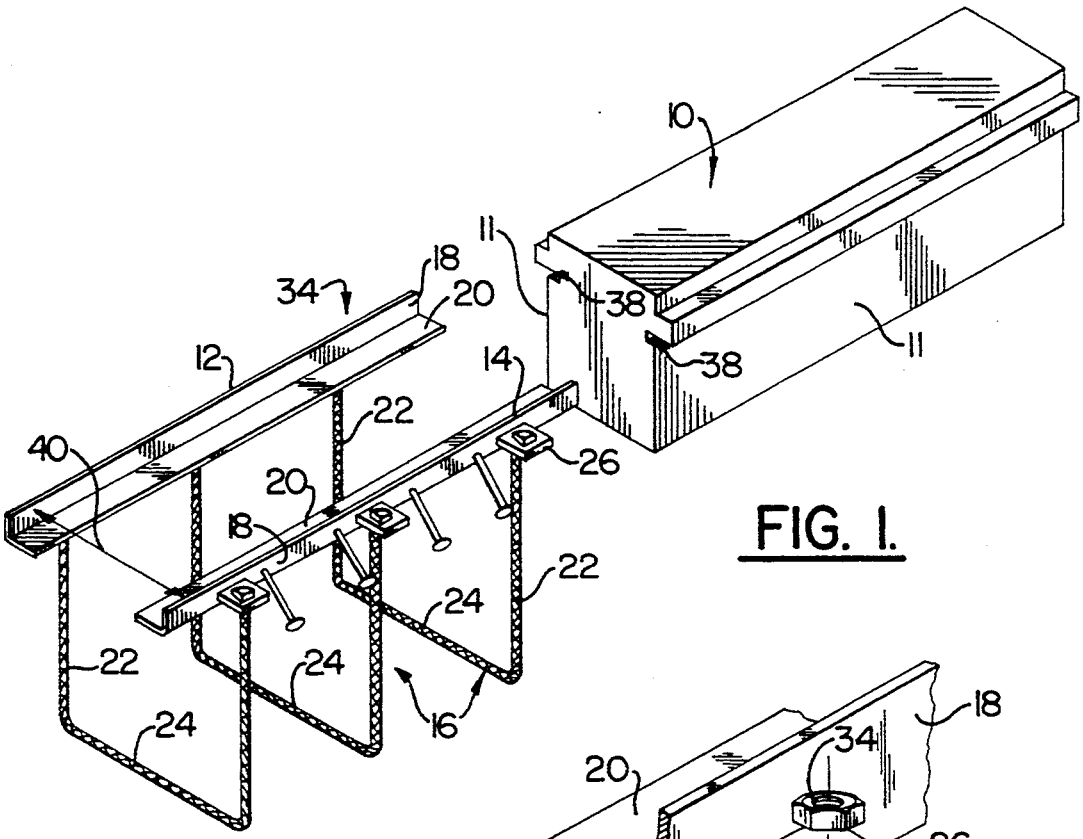
FIG. 1 illustrates one preferred trench assembly system, prior to complete assembly thereof including a plurality of U-shaped anchoring leg structures releasably connected to a pair of angled frame members; and, a form body is shown ready for insertion into the anchoring leg/frame member structure.

In the following detailed description, preferred method and apparatus embodiments of the invention are described in detail. Although the invention is described with reference to these specific preferred methods and apparatus, including those illustrated in the drawings, it will be understood that the invention is not intended to be so limited. To the contrary, the invention includes numerous alternatives, modifications and equivalents as will become apparent from the consideration of the foregoing discussion and the following detailed description.

In the preferred embodiments, the present invention employs form bodies and frame members which are engaged along a slot means formed on the sides of the form body. Such trench assembly structures are described in considerable detail in U.S. patent application Ser. No. 07/768,610 of Lannie L. Stegall, which is hereby incorporated by reference. Various details disclosed in the Stegall U.S. patent application Ser. No. 07/765,610 are not repeated herein for the sake of brevity. However, reference may be had to such patent application for further details.

FIG. 1 illustrates one preferred trench forming assembly in accordance with the invention. As illustrated, the assembly includes a form body 10 which is preferably made from a light weight inexpensive material such as expanded polystyrene. A pair of parallel, opposed frame members 12 and 14 are shown connected to a plurality of U-shaped anchoring structures 16.

Each of the frame members 12 and 14 includes an elongate vertically oriented leg 18 and an elongate horizontally oriented leg 20. The horizontally oriented elongate legs 20 are preferably aligned in a parallel relationship so as to define a support surface for a grate member in a finished trench. Typically, the horizontal legs act directly as the support surface for the grate. Alternatively, these legs can shape a portion of the trench forming composition into a flat surface as discussed in detail hereinafter. The elongate frame members 12 and 14 are advantageously formed of any of various well known metal materials. It will also be apparent that the frame members 12 and 14 could be formed from plastics or other materials where desirable.

Each of the U-shaped anchoring structures 16, comprises a pair of generally upwardly extending legs 22 which are joined together at their lower portions via integral horizontal members 24. The U-shaped structures can be integrally formed by bending a single rebar or other rod material.

Figure 2:
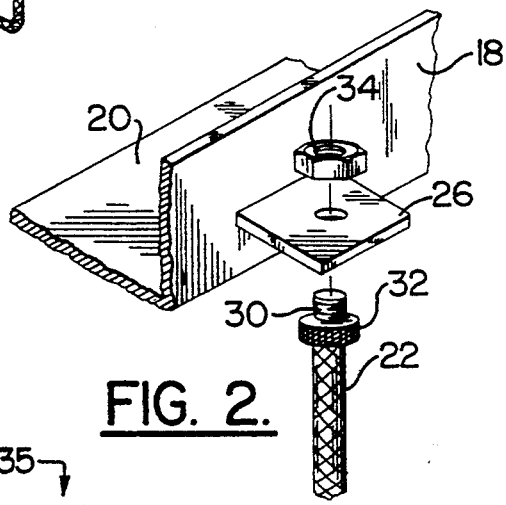
FIG. 2 is a greatly enlarged illustration of a portion of a frame member and an anchoring leg of FIG. 1 and illustrates one preferred means for detachably connecting an anchoring leg to a frame member.

Each of the upwardly oriented anchoring legs 22 is attached at an upper end portion thereof to a frame member 14 by means best seen in FIG. 2. As illustrated, the upper end portion of each anchoring leg 22 is preferably spaced from the corresponding lower portion. Each rail includes a plurality of laterally outwardly extending tab members 26 which are fixedly attached to the backsides of the vertical leg 18 of the frame member 14 by means as will be well known to those skilled in the art such as welding or the like. The tabs 26 each comprise a bore 28 sized to receive a threaded end portion 30 of an anchoring leg. A support member 32 is attached to the upper end of the anchoring leg 22 in order to support the bottom side of the tab 26 at a predetermined height along the anchoring leg 22. A nut or like fastening member 34 is provided for fastening onto threaded end 30 of the anchoring leg 22 to thereby secure the leg 22 to the outwardly extending tab 26.

Figure 3:
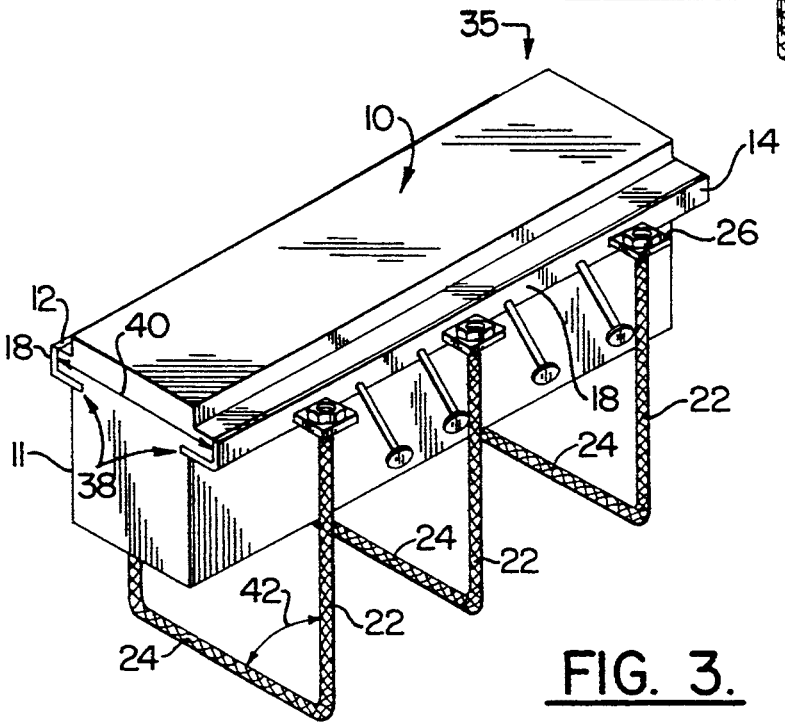
FIG. 3 illustrates the trench assembly of FIG. 1 in an assembled configuration.

Once assembled, the joined pair of anchoring legs 22 cooperate for engaging the frame members 12 and 14 with side surfaces 11 of form body 10 to create the assembled structure 35 shown in FIG. 3. This can be easily accomplished by sliding the form body 10 to provide the assembled frame member, anchoring leg structure 34 so that the horizontal legs 20 of the frame members are received in a pair of horizontal slots 38 integrally formed in form body 10. The horizontal slots 38 are advantageously co-planar slots which maintain the horizontal legs 20 of the frame members in substantially co-planar arrangement during the formation of a trench as discussed in detail hereinafter.

The U-shaped anchoring structures 16 are advantageously sized and arranged to maintain the frame members 12 at a predetermined distance 40 once the form body and frame member structure 34 has been assembled into the assembled structure illustrated in FIG. 3. As described in the aforementioned Stegall U.S. patent application, Ser. No. 07/768,610, the slots 38 in the form body 10 serve to both align the frame members 12 and 14, and also to maintain the form body 10 within a predetermined location during formation of a trench. Thus, engagement of the frame members 12 and 14 with the slots 38 of the form body is important during the trench forming process. In the past, wire members were typically used to secure the frame members to the form body. However, in the present invention the U-shaped anchoring members are constructed to effect such engagement without requiring the addition of tying members, such as wires.

In some cases, it is desirable that the opposed pairs of anchoring legs 22 be inwardly biased at their tops in order to enhance engagement of the frame members with the slots of the form body. This can be accomplished by any of various means, such as by bending the upwardly extending legs of the U-shaped members into a slightly acute angle 42 as generally indicated at in FIG. 3. Prior to assembly with the form body 10, the frame member and anchoring structure 34 (FIG. 1), is still relatively flexible so that the frame members can be easily moved with respect to each other, both outwardly and in a skewing motion. However, once the form body 10 has been engaged with the horizontal legs 20 of structure 34 to form the assembled structure 35 shown in FIG. 3, the frame members 12 and 14 are substantially secure against movement due to the geometry of the structure and the force applied to the frame members by the anchoring legs 22 which are joined together at their bottoms.

Figure 4:
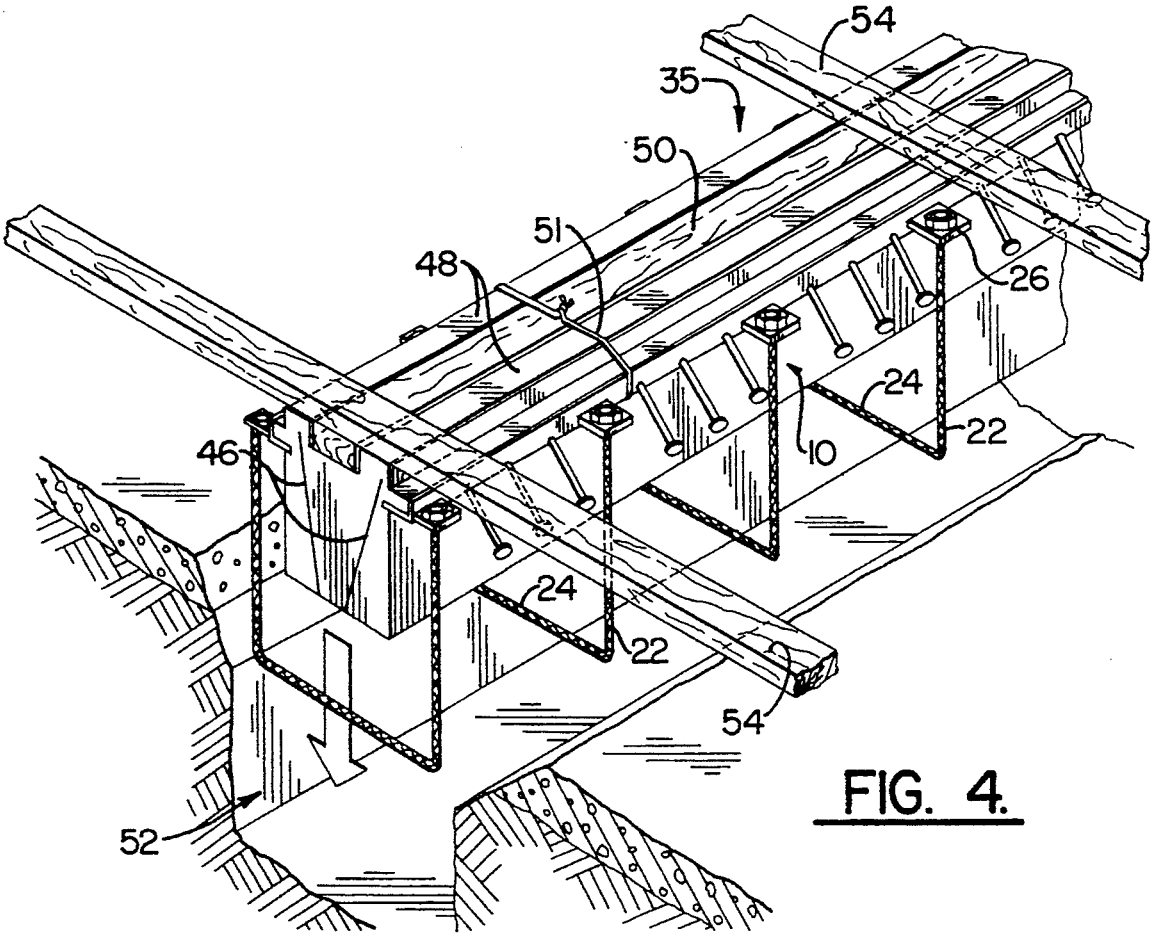
FIG. 4 illustrates a trench-forming assembly similar to that of FIG. 4 but additionally including an improved aligning means in the top of the form body for aligning the trench forming assembly over a ditch.
Figure 5:
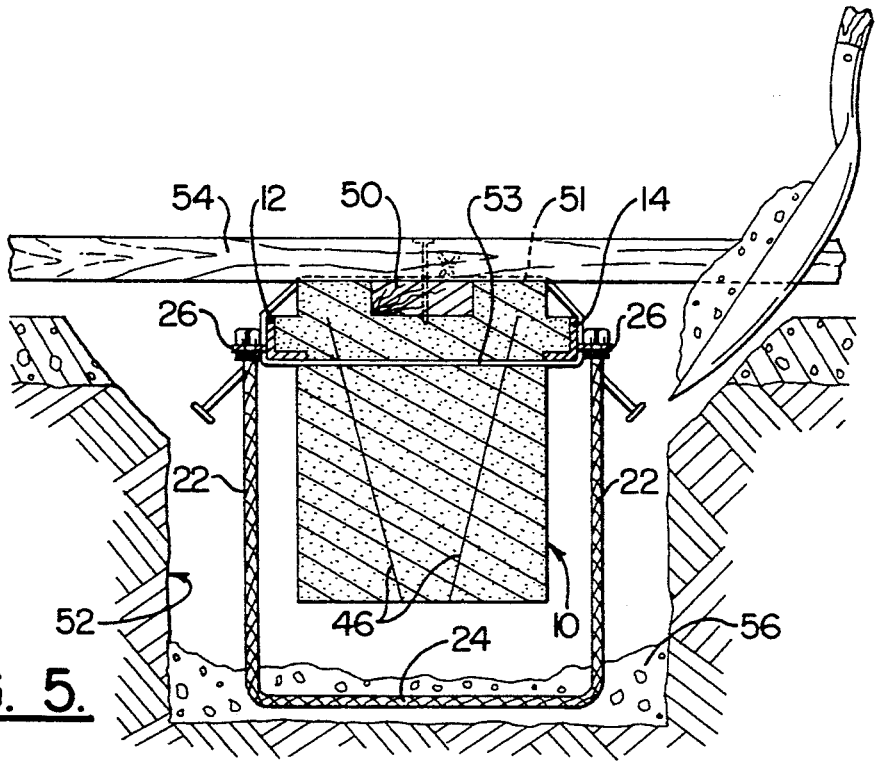
FIG. 5 illustrates the formation of a sub-slab for anchoring bottom portions of the U-shaped anchoring members in the bottom of the ditch.
Figure 6:
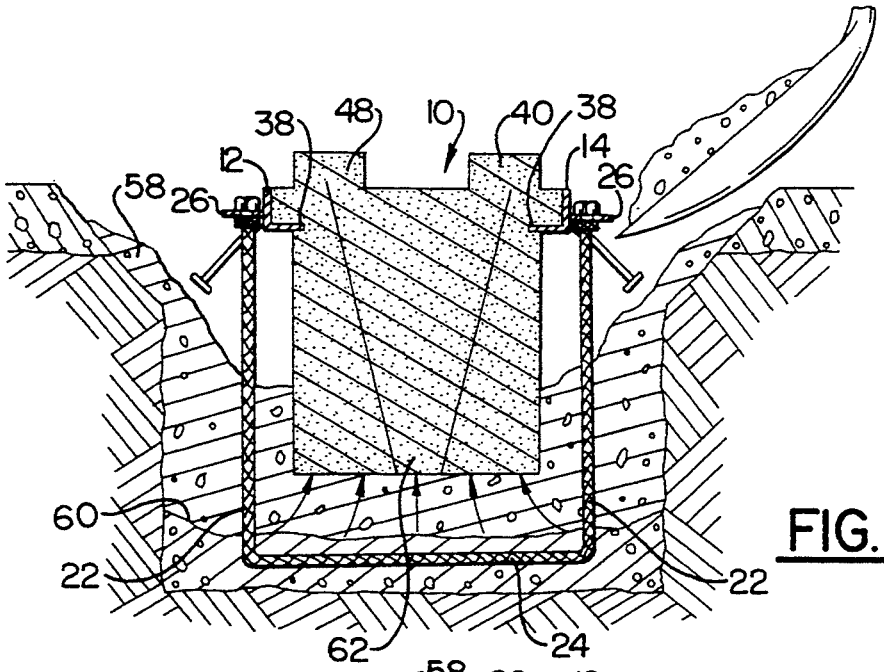
FIG. 6 illustrates the step of pouring concrete or a similar hardenable trench forming composition around the form body.

FIGS. 4, 5 and 6 illustrate formation of a trench in accordance invention. The form bodies employed in FIGS. 4–7 include an improved form removal means and an improved form alignment means as described in detail in U.S. patent application Ser. No. 08/121,042 of Lannie L. Stegall filed concurrently herewith entitled "METHOD AND APPARATUS FOR FORMING A TRENCH" which is hereby incorporated by reference. The improved form removal means includes a pair of upwardly extending slots 46 in the form body 10. The top portions of the slots 46 extend upwardly into a pair of spaced, elongate ears 48 which are sized and spaced to receive an alignment member 50 which assists in aligning the trench forming assembly 35 with a preformed ditch 52.

As illustrated in FIGS. 4 and 5, one or more cords or wires 51 may extend through a slot 53 formed laterally through the form body 10 and around the top surface thereof to secure the alignment member 50 to the trench forming assembly 35. Although not required, the cords or wires 51 may also be utilized to further secure the frame members 12 and 14 to the form body 10 if desired.

As best seen in FIG. 5, the assembly 35 is supported within a ditch 52 via batter boards 54 (only partially shown in FIG. 5). A sub-slab structure 56 is then prepared by covering the bottom horizontal members 24 of the U-shaped anchoring legs with concrete or hardenable trench forming composition such as a cementious material, a plastic-containing cementious material or the like as will be apparent to those skilled in the art. The sub-slab structure 56 is allowed to set, thereby securely bonding the lower members 24 of the anchoring members within the sub-slab assembly.

Figure 7:
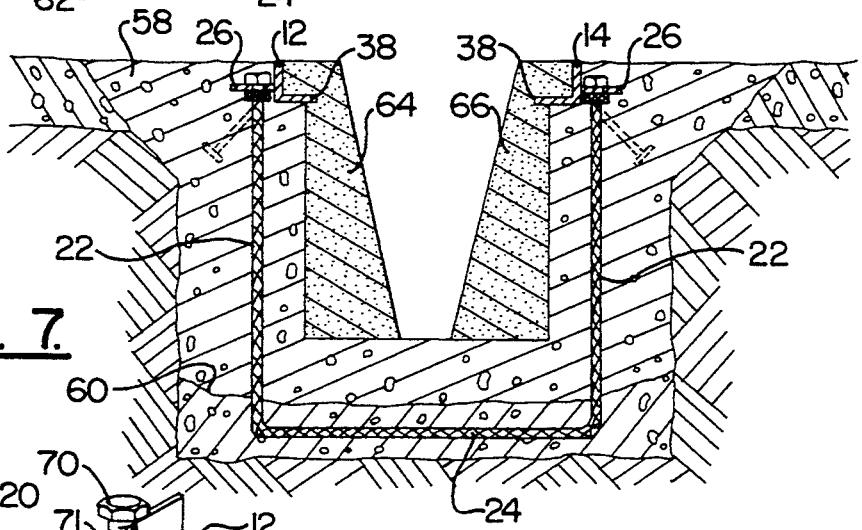
FIG. 7 illustrates the formed trench after a portion of the form body has been removed from the hardened trench.
Figure 10:
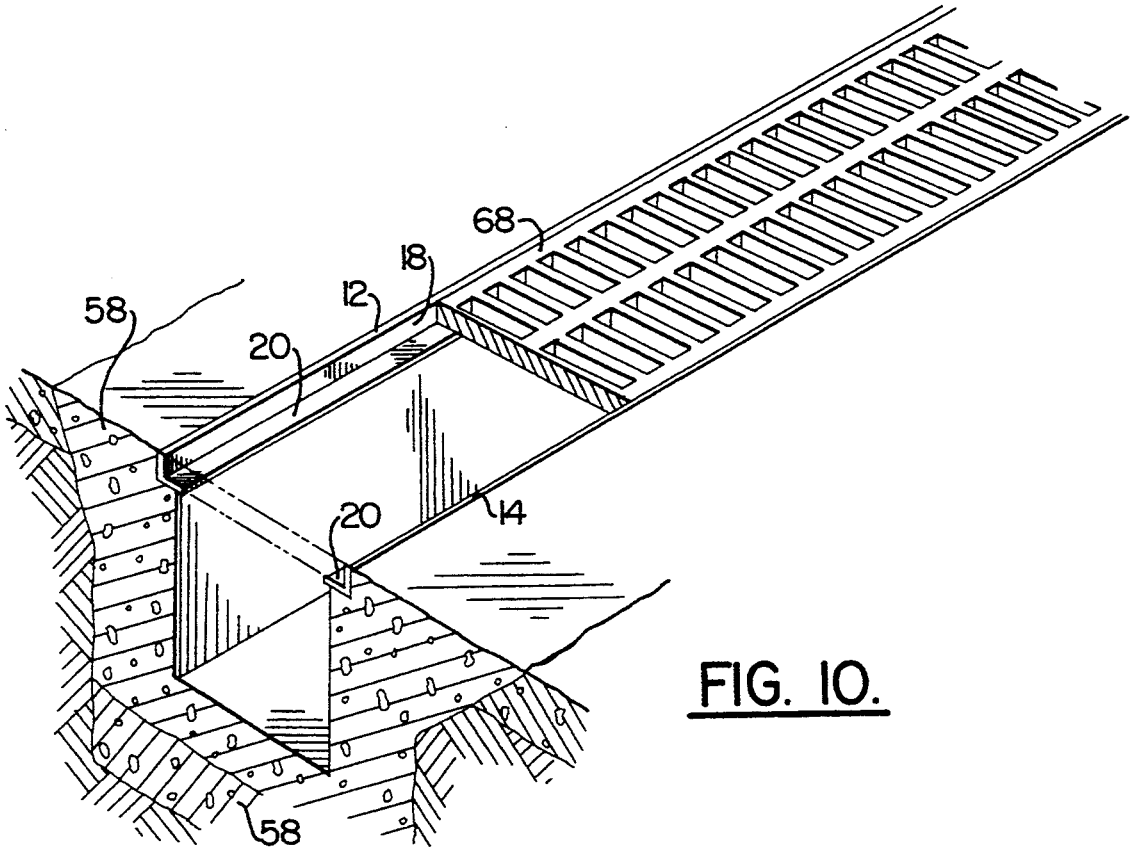
FIG. 10 illustrates a trench formed using the structures of FIGS. 1–7 and having a grate partially installed thereon.

Subsequently, as illustrated in FIG. 6, further hardenable trench forming material is filled into the ditch, around the form body 10. Although the form body 10 experiences significant upwardly directed hydraulic force as illustrated by the arrows shown in FIG. 6, the frame members 12 and 14 are sufficiently engaged into slots 38 of the form body so that the form does not move out of the ditch during pouring of the hardenable trench forming material. Because the trench forming material 58 is poured fully around the sides and beneath the bottom of the form body 10 in a single pour, the pour line 60 between the sub-slab and the main cement pouring does not intersect with the ultimately formed trench, thereby enhancing the integrity of the ultimately formed trench. Following hardening of the poured hardenable material, a least a portion of each of the elongate ears 48 is removed to thereby expose the slots in the form body and separate the form body 10 into a plurality of separate pieces, including a wedged-shape piece 62 which can then be readily removed as shown in FIG. 7. Thereafter the side portions of the form 64 and 66 can be removed to form the finished trench structure shown in FIG. 10. A grate member 68 is placed on the frame members 12 and 14 and is supported on the horizontal legs 20 thereof and between the vertical legs 18 thereof.

Figure 8:
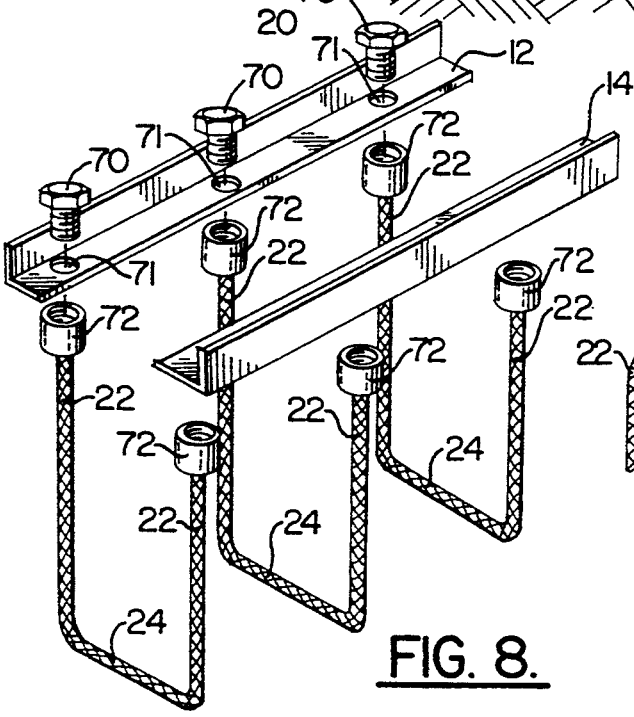
FIG. 8 illustrates an anchoring leg and elongate frame structure which, when used with form bodies as per FIGS. 1–7, allows removal of the frame members following formation of the trench.
Figure 9:
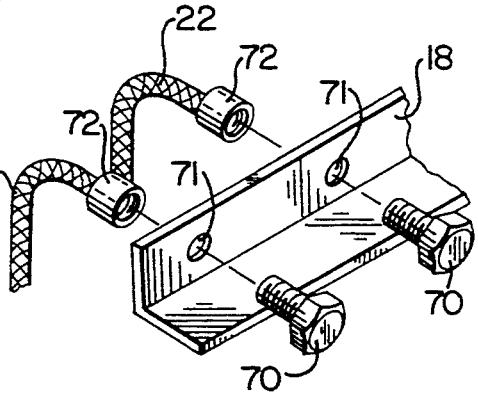
FIG. 9 illustrates a portion of an alternative to the structure of FIG. 8.

FIGS. 8 and 9 illustrate a structure in accordance with the invention which can be employed to form trenches wherein the frame members are removed following formation of the trench. In this case, the rail members 12 and 14 are attached to anchoring legs 22 via a disengageable connecting means. One disengageable connecting means, as shown in FIG. 8, can include a threaded mechanical fastener, such as a bolt 70, which is passed through a bore 71 in the horizontal leg 20 of the frame member for connecting to a threaded coupling member 72 attached to the upwardly extending leg 22.

An alternative arrangement is illustrated in FIG. 9. In this case, mechanical connectors 70 are passed through bores 71 in the vertical legs 18 of the frame members and are received in threaded coupling members 72 attached to a top portion of the anchoring legs 22.

The structures illustrated in FIGS. 8 and 9 are assembled and secured to a form body substantially as shown in FIGS. 3 and 4 and thereafter employed for forming a trench substantially in the manner previously discussed. Following hardening of the trench forming composition 58, the mechanical fasteners 70 may be released from inside portions of the elongate frame members 12 and 14; i.e. those portions of the frame members 12 and 14 which face the interior of the trench. The elongate frame members 12 and 14 can thus be disengaged from the anchoring rods to form the finished trench shown in FIG. 11.

Figure 11:
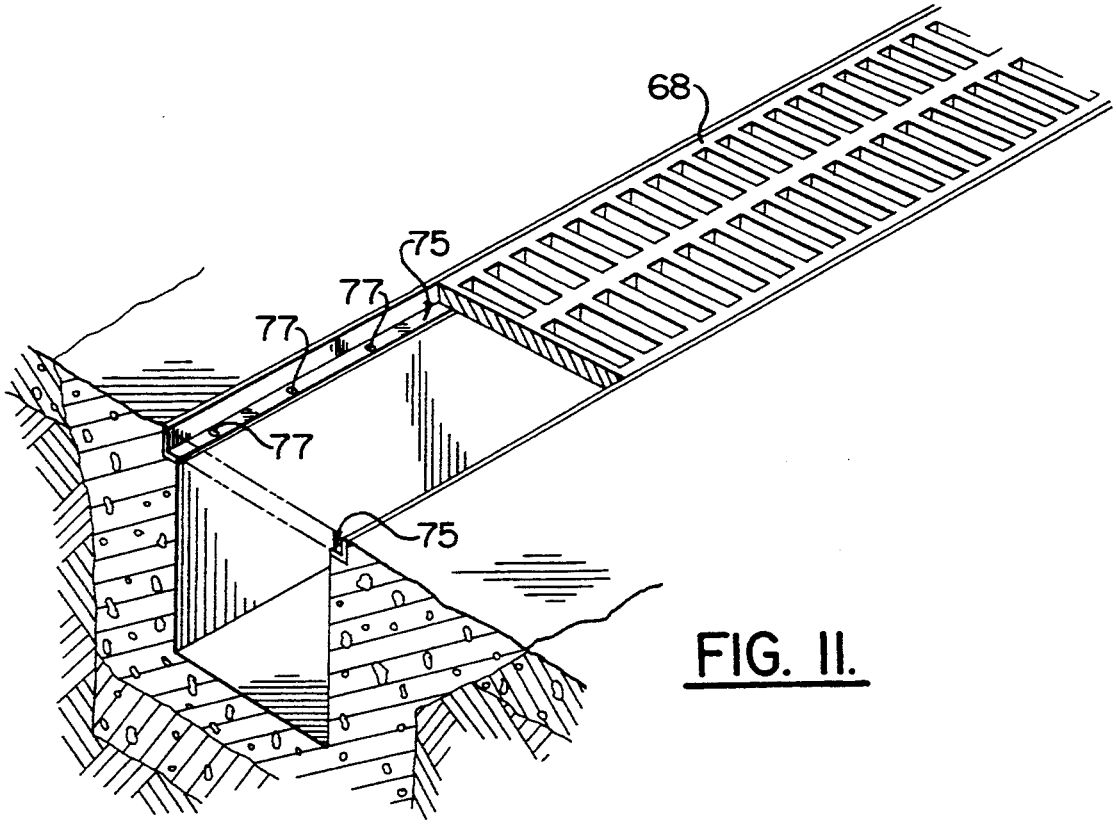
FIG. 11 illustrates a trench formed using the structures of FIG. 8 wherein the metal frame members have been removed prior to installation of the covering grate.

As shown in FIG. 11, the trench includes a pair of co-planar integrally formed recesses 75 which can support a trench covering grate 68 as illustrated. The holes 77 which are left on the surfaces of the integrally formed recesses 75 following removal of the frame members can be filled in with an appropriate cement or other filler material. Where desirable, any portion of the coupling member 72 which is exposed in the integrally formed recess may be removed, as by drilling, prior to filling in of the holes 77 with appropriate filler material. In some instances it may be desirable to form the coupling members 72 out of a soft metal or out of a plastic material which is either unobjectionable or can readily be removed by drilling following removal of the frame members.

Because the rail members can be removed in the structure shown in FIG. 11, the cost to form the trench is minimized substantially. In addition, in those environments where metals are objectionable, removal of the frame members eliminates the presence of objectionable metal surfaces.

The various inventions described herein are susceptible to numerous and varied modifications as will be apparent. Thus, although the invention has been described with reference to right angled elongate frame members, frame members of different shapes can also be employed in the invention. Such frame members can have various cross sectional shapes as more fully illustrated in concurrently filed U.S. patent application, Ser. No. 08/121,042, entitled "METHOD AND APPARATUS FOR FORMING A TRENCH" by Lannie L. Stegall which has been previously incorporated by reference.

In addition, although the invention has been described with reference to preferred engaging means for engaging the frame members with a form body, in the form of co-planar horizontal slots in the form body, it will also be apparent that other engaging means can be used for engaging the form body with frame members of various shapes. Similarly, although the preferred U-shaped anchoring members are shown as being formed from a single bent rod member, such as a rebar type material, it will be apparent that the U-shaped members can comprise upwardly extending legs joined at their bottom portions by separate members and that substantial variation in shape can be achieved while still resulting in a shape which is generally U-shaped. In addition, it will be apparent that other members for improving engagement of the frame members with forms, such as tying wires, can be used in combination with the U-shaped anchoring members of the present invention.

The invention has been described in considerable detail with reference to its preferred embodiments. However, as indicated previously, the improved trench assemblies and methods of the present invention are susceptible to numerous alternatives and variations within the spirit and scope of the invention as described in detail in the foregoing specification and defined in the appended claims.

That which is claimed is:

1. An apparatus for forming a trench of predetermined shape comprising:

a pair of parallel elongate frame members defining a support surface for supporting a trench cover;

an elongate form body substantially defining said predetermined shape of said trench and comprising opposed side surfaces, each of said frame members being connected to a different one of said opposed side surfaces along substantially the entire length thereof; and at least one pair of upwardly extending legs, each upwardly extending leg being joined at a top portion thereof to a different one of said frame members and being joined together at a lower portion thereof to the other of said legs forming said pair of legs, said pair of legs thereby forming a generally U-shaped structure connected to said form body for anchoring said form body in a predetermined location.

2. The trench forming assembly of claim 1 wherein said upwardly extending legs forming said pair of legs are integrally formed together into said generally U-shaped structure.

3. The trench forming assembly of claim 1 additionally comprising mechanical connectors for connecting said frame members to said top portions of said upwardly extending legs.

4. The trench forming assembly of claim 3 wherein said mechanical connectors comprise at least one tab member fixedly attached to a portion of each of said frame members and a mechanical fastening member for securing said upper portions of said upwardly extending legs to said tab members.

5. The trench forming assembly of claim 1 comprising a plurality of said pairs of said upwardly extending legs joined together at lower portions thereof joined to said frame members.

6. The trench forming assembly of claim 1 wherein said elongate frame members and said elongate form body are of substantially the same length.

7. The trench forming assembly of claim 1 wherein said upwardly extending legs of said generally U-shaped structure are biased inwardly for improving connectors of the frame members with said form body.

8. The trench forming assembly of claim 1 wherein said form body defines a pair of coplanar slots formed along the opposed sides of said form body.

9. The trench forming assembly of claim 1 additionally comprising disengageable connectors connecting said top portions of said upwardly extending legs to said elongate frame members, said disengageable connectors being adapted to provide disengagement of said elongate frame members from said legs following hardening of a trench forming composition.

10. A trench forming assembly for forming a trench of predetermined shape comprising:

a pair of parallel, elongate frame members defining a support surface for supporting a trench cover, each of said elongate frame members comprising an elongate horizontally leg;

an elongate form body for shaping a moldable trench forming composition into said predetermined shape of said trench and comprising opposed side surfaces;

a pair of co-planar elongate slots formed in said opposed side surfaces of said form body for engaging said horizontal legs of said elongate frame members; and at least one pair of upwardly extending legs for anchoring said frame members in a predetermined location, each upwardly extending leg being joined at a top portion to one of said frame members and being joined together at their lower portions to form a generally U-shaped anchoring member for maintaining said horizontal legs of said frame members in a predetermined spaced relationship for engagement with said slots of said form body.

11. The trench forming assembly of claim 10 wherein said upwardly extending legs forming said pair of upwardly extending legs of said U-shaped anchoring member are integrally formed from a single rod structure.

12. The trench forming assembly of claim 10 comprising a plurality of said anchoring members joined to said elongate frame members.

13. The trench forming assembly of claim 12 additionally comprising a plurality of mechanical fasteners for mechanically fastening said top portions of said upwardly extending legs to said elongate frame members.

14. The trench forming assembly of claim 13 wherein said mechanical fasteners comprise at least one tab member fixedly secured to each of said frame members, said tab member being adapted for connecting to a portion of one of said upwardly extending legs.

15. The trench forming assembly of claim 13 wherein said form body is made from an expanded plastic material.

16. The trench forming assembly of claim 15 wherein said expanded plastic material is expanded polystyrene.

17. The trench forming assembly of claim 15 wherein said form body comprises a pair of elongate upwardly extending elongate slots for separating said form body into pieces following a formation of said trench.

18. The trench forming assembly of claim 13 additionally comprising disengageable connectors connecting said top portions of said upwardly extending legs to said elongate frame members and being adapted to provide disengagement of said elongate frame members from said legs following hardening of said trench forming composition.

19. A trench forming assembly for forming a trench of predetermined shape comprising:

a pair of parallel elongate frame members defining a support surface for supporting a trench cover;

an elongate form body for shaping a hardenable trench forming composition into said predetermined shape of said trench and comprising opposed side surfaces, said opposed side surfaces of said form body being engaged with said elongate members along substantially the entire length of said form body;

at least one pair of upwardly extending legs for anchoring said frame means in a predetermined location, each upwardly extending leg joined at a top portion to one of said elongate frame members; and a plurality of disengageable connectors for connecting said top portions of said upwardly extending legs to said elongate frame members and being adapted to provide disengagement of said elongate frame members from said legs following hardening of said trench forming composition.

20. The trench forming assembly of claim 19 wherein said at least one pair of upwardly extending legs are joined together at lower portions thereof to form a generally U-shaped anchoring member for maintaining engagement of said frame members with said engagement means.

21. The trench forming assembly of claim 19 wherein said form body defines a pair of horizontal, coplanar slots formed in the opposed sides of said form body.

22. The trench forming assembly of claim 19 wherein said disengageable connectors include a bore formed through portion of each of said frame members for receiving a mechanical fastening member therethrough for connecting to one of said upwardly extending legs.

23. The trench forming assembly of claim 20 comprising a plurality of said U-shaped anchoring members connected to said elongate frame members.

24. The trench forming assembly of claim 23 wherein said upwardly extending legs of said U-shaped anchoring members are biased inwardly for improving engagement of said frame members with said side surfaces of said form body.

25. The trench forming assembly of claim 23 wherein said U-shaped anchoring members are each integrally formed from a single rod.

26. A trench forming assembly for forming a trench of predetermined shape comprising:

a pair of parallel elongate frame members for shaping a trench forming composition into a pair of parallel recesses to thereby define a support surface for supporting a trench cover;

an elongate form body for shaping a moldable trench forming composition into said predetermined shape of said trench and comprising opposed side surfaces, each of said side surfaces comprising an elongate horizontal slot adapted for engaging at least a portion of one of said frame members;

at least one pair of upwardly extending legs for anchoring said frame means in a predetermined location, each upwardly extending leg being joined at a top portion to one of said elongate frame members; and a plurality of disengageable connectors for connecting said top portions of said upwardly extending legs to said elongate frame members, said disengageable connectors being adapted to provide disengagement of said elongate frame members from said legs following hardening of said trench forming composition.

27. The trench forming assembly of claim 26 wherein said at least one pair of upwardly extending legs are joined together at a lower portion thereof to form a generally U-shaped anchoring member for maintaining engagement of said frame members with said slots in said form body.

28. The trench forming assembly of claim 27 comprising a plurality of said U-shaped anchoring members joined to said pair of frame members.

29. The trench forming assembly of claim 28 wherein said plurality of disengageable connectors comprise a plurality of bores formed in each of said elongate frame members, said bores being adapted for receiving a mechanical fastening member for fastening said frame members to said anchoring members.

30. A method for constructing an assembly for forming a trench of predetermined shape comprising:

aligning in parallel relationship a pair of elongate frame members each comprising an elongate planar leg defining a support surface for supporting a trench cover;

connecting said aligned frame members to end portions of a first pair of elongate anchoring legs joined together into a generally U-shaped structure at corresponding portions thereof spaced from said end portions; and engaging said aligned frame members along opposed side surfaces of an elongate form body of predetermined shape for shaping a hardenable trench forming composition into said predetermined shape of said trench to thereby form a trench forming assembly wherein said joined pair of anchoring legs cooperate for engaging said frame members with said side surfaces of said form body.

31. The method of claim 30 wherein said pair of anchoring legs are integrally formed together into said U-shaped structure.

32. The method of claim 30 wherein said connecting step is conducted by mechanically connecting said frame members to said end portions of said pair of joined legs.

33. The method of claim 32 wherein said connecting step comprises joining said end portions of said pair of anchoring legs to one tab members fixedly attached to a portion of each of said frame members.

34. The method of claim 30 comprising the additional step of connecting said aligned frame members to end portions of a second pair of elongate anchoring legs joined together into a generally U-shaped structure at corresponding portions thereof spaced from said end portions.

35. The method of claim 30 wherein said pair of anchoring legs are biased inwardly for improving engagement of the frame members with said form body.

36. The method of claim 30 wherein said engaging step comprises engaging said frame members into a pair of co-planar slots formed along the opposed sides of said form body.

37. The method of claim 30 wherein said connecting step comprises disengageably connecting said end portions of said pair of anchoring legs to said elongate frame members such that said frame members can be disengaged from said pair of anchoring legs by release of mechanical fasteners from inside portions of said elongate frame members.

38. A method for constructing an assembly for forming a trench of predetermined shape comprising:

aligning in parallel relationship a pair of elongate frame members each comprising an elongate planar leg for shaping support surface for supporting a trench cover;

disengageably connecting said aligned frame members to end portions of a first pair of elongate anchoring legs such that said frame members can be disengaged from said pair of anchoring legs from inside locations along said elongate frame members; and engaging said aligned frame members along opposed side surfaces of an elongate form body of predetermined shape for shaping a hardenable trench forming composition into said predetermined shape of said trench to thereby form a trench forming assembly wherein said aligned frame members can be disengaged from said anchoring legs following use of said assembly to form said trench.

39. The method of claim 38 wherein said pair of elongate anchoring legs are joined together into a generally U-shaped structure at corresponding portions thereof spaced from said end portions for maintaining engagement of said frame members with said side surfaces of said form body.

40. The method of claim 39 wherein said engaging step comprises engaging said frame members into a pair of co-planar slots formed along the opposed sides of said form body.

41. The method of claim 39 comprising the additional step of connecting said aligned frame members to end portions of a second pair of elongate anchoring legs joined together into a generally U-shaped structure at corresponding portions thereof spaced from said end portions.

42. The method of claim 38 wherein said engaging step comprises engaging said frame members into a pair of co-planar slots formed along the opposed sides of said form body.

43. The method of claim 38 wherein said step of disengageably connecting said frame members to said anchoring legs comprises mechanically fastening said frame members to said anchoring legs through bores formed through portions of each of said frame members.

* * * * *